US008821214B2

(12) United States Patent
Joseph

(10) Patent No.: US 8,821,214 B2
(45) Date of Patent: Sep. 2, 2014

(54) POLISHING PAD WITH POROUS ELEMENTS AND METHOD OF MAKING AND USING THE SAME

(75) Inventor: William D. Joseph, Maplewood, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 868 days.

(21) Appl. No.: 13/000,986

(22) PCT Filed: Jun. 26, 2009

(86) PCT No.: PCT/US2009/048940
§ 371 (c)(1),
(2), (4) Date: Mar. 14, 2011

(87) PCT Pub. No.: WO2009/158665
PCT Pub. Date: Dec. 30, 2009

(65) Prior Publication Data

US 2011/0159786 A1 Jun. 30, 2011

Related U.S. Application Data

(60) Provisional application No. 61/075,970, filed on Jun. 26, 2008.

(51) Int. Cl.
*B24B 37/26* (2012.01)
*B24B 37/04* (2012.01)

(52) U.S. Cl.
CPC ..... *B24B 37/042* (2013.01); *B24B 37/26* (2013.01)
USPC ..... 451/41; 451/529; 451/527

(58) Field of Classification Search
CPC ..... B24D 3/32; B24D 37/04; B24D 37/11; B24D 37/20; B24D 37/245
USPC ..... 451/526, 527, 529, 530, 41
See application file for complete search history.

(56) References Cited

U.S. PATENT DOCUMENTS 5,212,910 A * 5/1993 Breivogel et al. ..... 451/530
5,257,478 A 11/1993 Hyde et al.

(Continued)

FOREIGN PATENT DOCUMENTS

EP 0824995 A1 2/1998
EP 0845328 A2 6/1998

(Continued)

OTHER PUBLICATIONS

Search Report from Taiwan patent application No. 098121709, dated Oct. 20, 2012, 1 p.

(Continued)

*Primary Examiner* — Robert Rose
(74) *Attorney, Agent, or Firm* — Shumaker & Sieffert, P.A.

(57) ABSTRACT

The disclosure is directed to polishing pads with porous polishing elements, and to methods of making and using such pads in a polishing process. In one exemplary embodiment, the polishing pad includes a multiplicity of polishing elements, at least some of which are porous, each polishing element affixed to a support layer so as to restrict lateral movement of the polishing elements with respect to one or more of the other polishing elements, but remaining moveable in an axis normal to a polishing surface of the polishing elements. In certain embodiments, the polishing pad may include a guide plate positioned to arrange and optionally affix the plurality of polishing elements on the support layer, and additionally, a polishing composition distribution layer. In some embodiments, the pores are distributed throughout substantially the entire porous polishing element. In other embodiments, the pores are distributed substantially at the polishing surface of the elements.

17 Claims, 6 Drawing Sheets

(56) References Cited

U.S. PATENT DOCUMENTS

| | | | | |
|---|---|---|---|---|
| 5,609,517 | A * | 3/1997 | Lofaro | 451/529 |
| 5,921,855 | A | 7/1999 | Osterheld et al. | |
| 6,077,153 | A | 6/2000 | Fujita et al. | |
| 6,126,532 | A | 10/2000 | Sevilla et al. | |
| 6,238,592 | B1 | 5/2001 | Hardy et al. | |
| 6,309,276 | B1 | 10/2001 | Tsai et al. | |
| 6,491,843 | B1 | 12/2002 | Srinivasan et al. | |
| 6,899,598 | B2 | 5/2005 | Prasad | |
| 6,908,366 | B2 | 6/2005 | Gagliardi | |
| 7,267,610 | B1 | 9/2007 | Elmufdi et al. | |
| 7,530,880 | B2 * | 5/2009 | Bajaj et al. | 451/5 |
| 2001/0039175 | A1 * | 11/2001 | Golzarian et al. | 451/526 |
| 2002/0111120 | A1 | 8/2002 | Goetz | |
| 2003/0153245 | A1 | 8/2003 | Talieh et al. | |
| 2004/0171339 | A1 | 9/2004 | Prasad | |
| 2006/0046622 | A1 | 3/2006 | Prasad | |
| 2007/0128991 | A1 | 6/2007 | Yoon et al. | |
| 2007/0224925 | A1 | 9/2007 | Bajaj | |
| 2011/0159786 | A1 | 6/2011 | Joseph | |

FOREIGN PATENT DOCUMENTS

| | | | |
|---|---|---|---|
| EP | 1114697 | A2 | 7/2001 |
| EP | 1255286 | A1 | 11/2002 |
| EP | 1764189 | A1 | 3/2007 |
| JP | 2003168667 | A | 6/2003 |
| JP | 2004160573 | A | 6/2004 |
| JP | 2006142439 | A | 6/2006 |
| KR | 20040035089 | A | 4/2004 |
| KR | 0761847 | A | 9/2007 |
| KR | 0790217 | A | 12/2007 |
| WO | 95/11772 | A1 | 5/1995 |
| WO | 9527595 | A | 10/1995 |
| WO | 0216078 | A2 | 2/2002 |
| WO | 0233736 | A1 | 4/2002 |
| WO | 0243925 | A1 | 6/2002 |
| WO | 02053324 | A1 | 7/2002 |
| WO | 02100594 | A1 | 12/2002 |
| WO | 2005002794 | A2 | 1/2005 |
| WO | 2006042010 | A1 | 4/2006 |
| WO | 2006055720 | A1 | 5/2006 |
| WO | 2006057714 | A2 | 6/2006 |
| WO | 2006093625 | A1 | 9/2006 |
| WO | 2009032768 | A2 | 3/2009 |

OTHER PUBLICATIONS

Written Opinion and Search Report from Singapore application No. 201009480-3, dated Mar. 5, 2012, 15 pp.

Office Action from European Patent Application No. 09771196.4, dated Oct. 22, 2012, 5 pp.

Office Action from Korean Patent Application No. 10-2011-7001943, dated Sep. 20, 2012, 10 pp.

U.S. Appl. No. 12/991,097, by Rajeev Bajaj, filed Feb. 28, 2011.

U.S. Appl. No. 13/054,691, by William D. Joseph, filed Mar. 29, 2011.

Office Action from Chinese patent application No. 2009801334492, dated Oct. 30, 2012, 6 pp.

Office Action and Search Report from Taiwan patent application No. 098121709, dated Nov. 12, 2012, 13 pp.

* cited by examiner

POLISHING PAD WITH POROUS ELEMENTS AND METHOD OF MAKING AND USING THE SAME

TECHNICAL FIELD

The present disclosure relates to polishing pads with porous polishing elements, and to methods of making and using such polishing pads in a polishing process, for example, in a chemical mechanical planarization process.

BACKGROUND

During the manufacture of semiconductor devices and integrated circuits, silicon wafers are iteratively processed through a series of deposition and etching steps to form overlying material layers and device structures. A polishing technique known as chemical mechanical planarization (CMP) may be used to remove surface irregularities (such as bumps, areas of unequal elevation, troughs, and trenches) remaining after the deposition and etching steps, with the objective of obtaining a smooth wafer surface without scratches or depressions (known as dishing), with high uniformity across the wafer surface.

In a typical CMP polishing process, a substrate such as a wafer is pressed against and relatively moved with respect to a polishing pad in the presence of a working liquid that is typically a slurry of abrasive particles in water and/or an etching chemistry. Various CMP polishing pads for use with abrasive slurries have been disclosed, for example, U.S. Pat. Nos. 5,257,478; 5,921,855; 6,126,532; 6,899,598 B2; and 7,267,610. Fixed abrasive polishing pads are also known, as exemplified by U.S. Pat. No. 6,908,366 B2, in which the abrasive particles are generally fixed to the surface of the pad, often in the form of precisely shaped abrasive composites extending from the pad surface. Recently, a polishing pad having a multiplicity of polishing elements extending from a compressible underlayer was described in WO/2006057714. Although a wide variety of polishing pads are known and used, the art continues to seek new and improved polishing pads for CMP, particularly in CMP processes where larger die diameters are being used, or where higher levels of wafer surface flatness and polishing uniformity are required.

SUMMARY

In one exemplary embodiment, the present disclosure describes a polishing pad comprising a plurality of polishing elements, each of the polishing elements affixed to a support layer so as to restrict lateral movement of the polishing elements with respect to one or more of the other polishing elements, but remaining moveable in an axis normal to a polishing surface of the polishing elements, wherein at least a portion of the polishing elements comprise porous polishing elements, and wherein at least a surface of each porous polishing element comprises a plurality of pores.

In certain embodiments, the pores may be distributed throughout substantially the entire porous polishing element. In other exemplary embodiments, the pores may be distributed substantially at the polishing surface of the element. In some particular exemplary embodiments, the pores distributed substantially at the polishing surface of the element comprise a plurality of channels having a cross-sectional shape selected from the group consisting of cylindrical, triangular, rectangular, trapezoidal, hemispherical, and combinations thereof.

In another exemplary embodiment, the present disclosure describes a polishing pad comprising a support layer having a first major side and a second major side opposite the first major side, a plurality of polishing elements affixed to the first major side of the support layer, and a guide plate having a first major surface and a second major surface opposite the first major surface, the guide plate positioned to arrange the plurality of polishing elements on the first major side with the first major surface distal from the support layer, wherein the polishing elements extend from the first major surface of the guide plate along a first direction substantially normal to the first major side, wherein at least a portion of the polishing elements comprise porous polishing elements, and wherein at least a portion of each porous polishing element comprises a plurality of pores.

In certain exemplary embodiments, the pores may be distributed throughout substantially the entire porous polishing element. In other exemplary embodiments, the pores may be distributed substantially at the polishing surface of the elements. In some particular exemplary embodiments, the pores distributed substantially at the polishing surface of the element comprise a plurality of channels having a cross-sectional shape selected from the group consisting of cylindrical, triangular, rectangular, trapezoidal, hemispherical, and combinations thereof.

In an additional exemplary embodiment, the present disclosure is directed to a method of using a polishing pad as described above in a polishing process, the method comprising contacting a surface of a substrate with a polishing surface of a polishing pad comprising a plurality of polishing elements, at least some of which are porous, and relatively moving the polishing pad with respect to the substrate to abrade the surface of the substrate. In certain exemplary embodiments, a working liquid may be provided to an interface between the polishing pad surface and the substrate surface.

In a further exemplary embodiment, a method of making a polishing pad is provided, the method comprising forming a plurality of porous polishing elements, and affixing the porous polishing elements to a support layer. In certain embodiments, the method includes forming the porous polishing elements by injection molding of a gas saturated polymer melt, injection molding of a reactive mixture that evolves a gas upon reaction to form a polymer, injection molding of a mixture comprising a polymer dissolved in a supercritical gas, injection molding of a mixture of incompatible polymers in a solvent, injection molding of porous thermoset particulates dispersed in a thermoplastic polymer, and combinations thereof.

Exemplary embodiments of polishing pads having porous polishing elements according to the present disclosure have various features and characteristics that enable their use in a variety of polishing applications. In some presently preferred embodiments, polishing pads of the present disclosure may be particularly well suited for chemical mechanical planarization (CMP) of wafers used in manufacturing integrated circuits and semiconductor devices. In certain exemplary embodiments, the polishing pad described in this disclosure may provide some or all of the following advantages.

For example, in some exemplary embodiments, a polishing pad according to the present disclosure may act to better retain a working liquid used in the CMP process at the interface between the polishing surface of the pad and the substrate surface being polished, thereby improving the effectiveness of the working liquid in augmenting polishing. In other exemplary embodiments, a polishing pad according to the present disclosure may reduce or eliminate dishing and/or edge erosion of the wafer surface during polishing. In some exemplary embodiments, use of a polishing pad according to the present disclosure in a CMP process may result in improved within wafer polishing uniformity, a flatter polished wafer surface, an increase in edge die yield from the wafer, and improved CMP process operating latitude and consistency.

In further exemplary embodiments, use of a polishing pad with porous elements according to the present disclosure may permit processing of larger diameter wafers while maintaining the required degree of surface uniformity to obtain high chip yield, processing of more wafers before conditioning of the pad surface is needed in order to maintain polishing uniformity of the wafer surfaces, or reducing process time and wear on the pad conditioner. In certain embodiments, CMP pads with porous polishing elements may also offer the benefits and advantages of conventional CMP pads having surface textures such as grooves, but may be manufactured more reproducibly at a lower cost.

Various aspects and advantages of exemplary embodiments of the disclosure have been summarized. The above Summary is not intended to describe each illustrated embodiment or every implementation of the present certain exemplary embodiments of the present invention. The Drawings and the Detailed Description that follow more particularly exemplify certain preferred embodiments using the principles disclosed herein.

BRIEF DESCRIPTION OF DRAWINGS

Exemplary embodiments of the present disclosure are further described with reference to the appended figures, wherein.

Like reference numerals in the drawings indicate like elements. The drawings herein as not to scale, and in the drawings the components of the polishing pads are sized to emphasize selected features.

DETAILED DESCRIPTION

In a typical CMP slurry process for wafer polishing, a wafer possessing a characteristic topography is put in contact with a polishing pad and a polishing solution containing an abrasive and a polishing chemistry. If the polishing pad is compliant, the phenomenon of dishing and erosion may occur due to the soft pad polishing the low areas on the wafer at the same rate as the raised areas. If the polishing pad is rigid, dishing and erosion may be greatly reduced; however, although rigid polishing pads may advantageously yield good within die planarization uniformity, they may also disadvantageously yield poor within wafer uniformity, due to a rebound effect which occurs on the wafer perimeter. This rebound effect results in poor edge yield and a narrow CMP polishing process window. In addition, it may be difficult to develop a stable polishing process with a rigid polishing pad, because such pads are sensitive to different wafer topographies, and are completely dependent upon use of a pad conditioner to create an optimal polishing texture which holds the polishing solution and interfaces with the wafer.

The present disclosure is directed to improved polishing pads with porous polishing elements, which in various embodiments combine some of the advantageous characteristics of both compliant and rigid polishing pads, while eliminating or reducing some of the disadvantageous characteristics of the respective pads. Various exemplary embodiments of the disclosure will now be described with particular reference to the Drawings. Exemplary embodiments of the present disclosure may take on various modifications and alterations without departing from the spirit and scope of the disclosure. Accordingly, it is to be understood that the embodiments of the present invention are not to be limited to the following described exemplary embodiments, but are to be controlled by the limitations set forth in the claims and any equivalents thereof.

Figure 1:
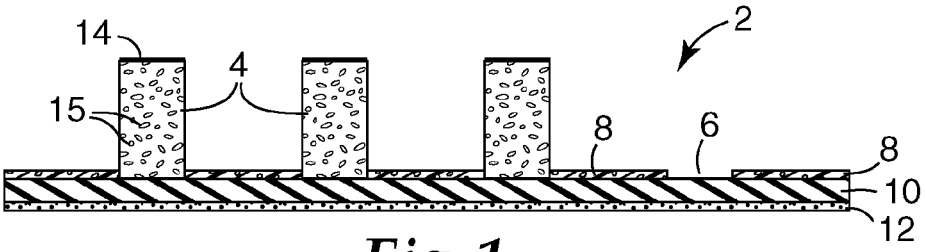
FIG. 1 is a side view of a polishing pad having projecting porous elements according to one exemplary embodiment of the disclosure.

Referring to FIG. 1, an exemplary embodiment of a polishing pad 2 is shown, comprising a plurality of polishing elements 4, each of the polishing elements 4 being affixed to a support layer 10 so as to restrict lateral movement of the polishing elements 4 with respect to one or more of the other polishing elements 4, but remaining moveable in an axis normal to a polishing surface 14 of each polishing element 4. At least a portion of the polishing elements 4 are porous, in which at least a surface of the polishing element 4, in this case at least polishing surface 14, comprises a plurality of pores (not shown in FIG. 1). In the particular embodiment illustrated by FIG. 1, each of the porous polishing elements 4 is also shown as having a plurality of pores 15 distributed substantially throughout the entire polishing element 4. In other exemplary embodiments (not shown in FIG. 1, but illustrated by FIGS. 3-4), the pores are distributed substantially at or near only the polishing surface 14 of the polishing elements 4.

Additionally, in the particular embodiment illustrated by FIG. 1, three polishing elements 4 are shown, and all of the polishing elements 4 are shown as porous polishing elements including both a porous polishing surface 14 and pores 15 distributed substantially throughout the entire polishing element 4. However, it will be understood that any number of polishing elements 4 may be used, and the number of porous polishing elements may be selected to be as few as one polishing element, to as many as all of the polishing elements, or any number in between.

Furthermore, it will be understood that the polishing pad 2 need not comprise only substantially identical polishing elements 4. Thus, for example, any combination or arrangement of porous polishing elements and non-porous polishing elements may make up the plurality of porous polishing elements 4. In addition, polishing pads 2 having combinations or arrangements of polishing elements 4 with pores distributed substantially throughout the entire polishing element 4, polishing elements 4 with pores distributed substantially at or near only the polishing surface 14 of the polishing element 4, and polishing elements 4 with substantially no pores, may also be advantageously fabricated.

In the particular embodiment illustrated by FIG. 1, the polishing elements 4 are shown affixed to a first major side of the support layer 10, for example by direct bonding to the support layer, or using an adhesive. An optional polishing composition distribution layer 8, which may also serve as a guide plate for the polishing elements, is additionally shown in FIG. 1. During a polishing process, the optional polishing composition distribution layer 8 aids distribution of the working liquid and/or polishing slurry to the individual polishing elements 4.

When used as a guide plate, the polishing composition distribution layer 8 (guide plate) may be positioned on the first major side of the support layer 10 to facilitate arrangement of the plurality of polishing elements 4, such that a first major surface of the polishing composition distribution layer 8 (guide plate) is distal from the support layer 10, and a second major surface of the polishing composition distribution layer 8 (guide plate) is opposite the first major surface of the polishing composition distribution layer 8 (guide plate).

The polishing elements extend from the first major surface of the polishing composition distribution layer 8 (guide plate) along a first direction substantially normal to the first major side of the support layer 10. If polishing composition distribution layer 8 is also used as a guide plate, then preferably, a plurality of apertures 6 are provided extending through the polishing composition distribution layer 8 (guide plate). A portion of each polishing element 4 extends into a corresponding aperture 6. Thus, the plurality of apertures 6 serves to guide the arrangement of polishing elements 4 on the support layer 10.

In the particular embodiment illustrated by FIG. 1, an optional pressure sensitive adhesive layer 12, which may be used to secure the polishing pad 2 to a polishing platen (not shown in FIG. 1) of a CMP polishing apparatus (not shown in FIG. 1), is shown adjacent to the support layer 10, opposite the polishing composition distribution layer 8.

Figure 2:
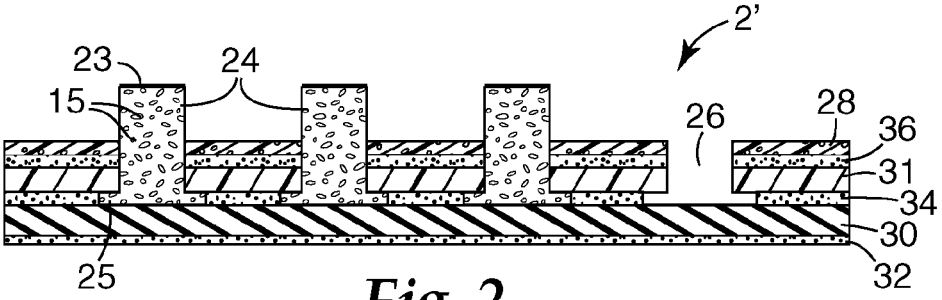
FIG. 2 is a side view of a polishing pad having projecting porous elements according to another exemplary embodiment of the disclosure.

Referring to FIG. 2, another exemplary embodiment of a polishing pad 2' is shown, the polishing pad 2' comprising a support layer 30 having a first major side and a second major side opposite the first major side; a plurality of polishing elements 24, each polishing element 24 having a mounting flange 25 for affixing each polishing element 24 to the first major side of the support layer 30; and a guide plate 31 having a first major surface and a second major surface opposite the first major surface, the guide plate 31 positioned to arrange the plurality of polishing elements 24 on the first major side of support layer 30 with the first major surface of guide plate 31 distal from the support layer 30.

As illustrated by FIG. 2, each polishing element 24 extends from the first major surface of the guide plate 31 along a first direction substantially normal to the first major side. At least a portion of the polishing elements 24 comprise porous polishing elements, and at least a portion of each porous polishing element, in this case polishing surface 23, comprises a plurality of pores (not shown in FIG. 2). In the particular embodiment illustrated by FIG. 2, each of the porous polishing elements 24 is also shown as having a plurality of pores 15 distributed substantially throughout the entire polishing element 24. In other exemplary embodiments (not shown in FIG. 2, but shown in FIGS. 4A-4C), the pores 15 are distributed substantially at or near only the polishing surface 23 of the polishing elements 24.

Additionally, in the particular embodiment illustrated by FIG. 2, three polishing elements 24 are shown, and all of the polishing elements 24 are shown as porous polishing elements including both a porous polishing surface 14 and pores 15 distributed substantially throughout the entire polishing element 24. However, it will be understood that any number of polishing elements 24 may be used, and the number of porous polishing elements may be selected to be as few as one polishing element, to as many as all of the polishing elements, or any number in between.

Furthermore, it will be understood that the polishing pad 2' need not comprise only substantially identical polishing elements 24. Thus, for example, any combination or arrangement of porous polishing elements and non-porous polishing elements may make up the plurality of porous polishing elements 24. In addition, polishing pads 2' having combinations or arrangements of polishing elements 24 with pores distributed substantially throughout the entire polishing element 24, polishing elements 24 with pores distributed substantially at or near only the polishing surface 23 of the polishing element 24, and polishing elements 24 with substantially no pores, may also be advantageously fabricated.

An optional polishing composition distribution layer 28 is additionally illustrated by FIG. 2. During a polishing process, the optional polishing composition distribution layer 28 aids distribution of the working liquid and/or polishing slurry to the individual polishing elements 24. A plurality of apertures 26 may also be provided extending through at least the guide plate 31 and the optional polishing composition distribution layer 28 as illustrated by FIG. 2.

As illustrated by FIG. 2, in some embodiments, each polishing element 24 has a mounting flange 25, and each polishing element 24 is affixed to the first major side of the support layer 30 by engagement of the corresponding flange 25 to the second major surface of the guide layer 31. At least a portion of each polishing element 24 extends into a corresponding aperture 26, and each polishing element 24 also passes through the corresponding aperture 26 and extends outwardly from the first major surface of the guide plate 31. Thus, the plurality of apertures 26 of guide plate 31 serves to guide the lateral arrangement of polishing elements 24 on the support layer 30, while also engaging with each flange 25 to affix each the corresponding polishing element 24 to the support layer 30.

Consequently, during a polishing process, the polishing elements 24 are free to independently undergo displacement in a direction substantially normal to the first major side of support layer 30, while still remaining affixed to the support layer 30 by the guide plate 31. In some embodiments, this may permit non-compliant polishing elements, for example, porous polishing elements having pores distributed substantially at or near only the polishing surface. Such porous polishing elements may be useful as compliant polishing elements exhibiting some of the advantageous characteristics of a compliant polishing pad.

In the particular embodiment illustrated by FIG. 2, the polishing elements 24 are additionally affixed to a first major side of the support layer 30 using an adhesive an optional adhesive layer 34 positioned at an interface between the support layer 30 and the guide plate 31. However, other bonding methods may be used, including direct bonding of the polishing elements 24 to the support layer 30 using, for example, heat and pressure. Such polishing elements may be useful as non-compliant polishing elements exhibiting some of the advantageous characteristics of a non-compliant polishing pad.

In a related exemplary embodiment not illustrated in FIG. 2, the plurality of apertures may be arranged as an array of apertures, wherein at least a portion of the apertures 26 comprise a main bore and an undercut region of guide plate 31, and the undercut region forms a shoulder that engages with the corresponding polishing element flange 25, thereby retaining the polishing element 24 without requiring an adhesive between the polishing element 24 and the support layer 30.

Furthermore, an optional adhesive layer 36 may be used affix the optional polishing composition distribution layer 28 to a first major surface of the guide plate 31, as illustrated by FIG. 2. In addition, in the particular embodiment illustrated by FIG. 2, an optional pressure sensitive adhesive layer 32, which may be used to secure the polishing pad 2' to a polishing platen (not shown in FIG. 2) of a CMP polishing apparatus (not shown in FIG. 2), is shown adjacent to the support layer 30, opposite the guide plate 31.

Figure 3A:
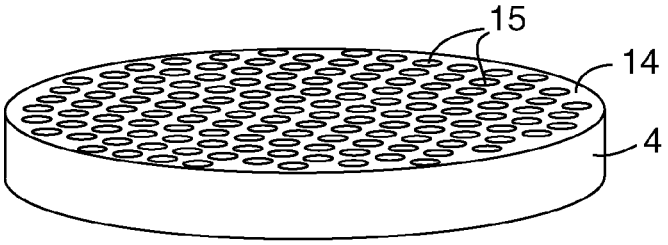
FIG. 3A is a perspective view of a porous polishing element according to one exemplary embodiment of the disclosure.
Figure 3B:
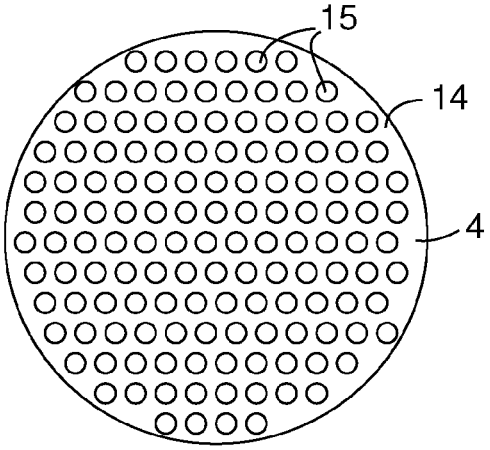
FIG. 3B is a top view of the exemplary porous polishing element of FIG. 3A.
Figure 4A:
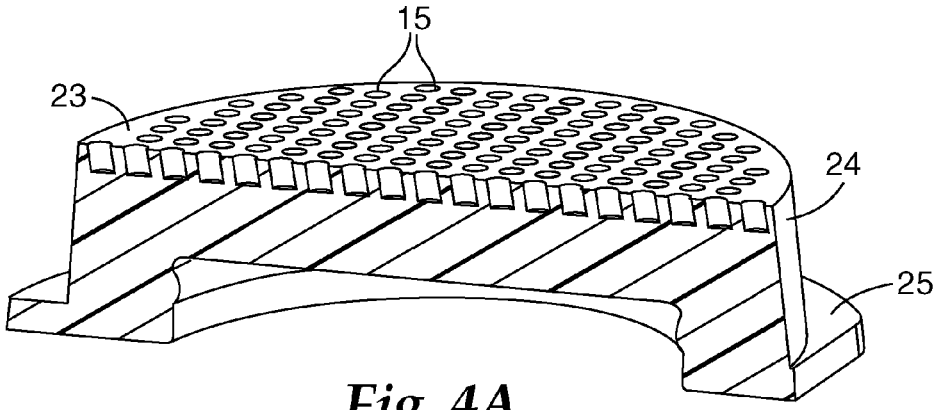
FIG. 4A is a perspective view of a porous polishing element according to another exemplary embodiment of the disclosure.

Referring to FIGS. 3A-3B, the cross-sectional shape of the polishing elements 4, taken through a polishing element 4 in a direction generally parallel to the polishing surface 14, may vary widely depending on the intended application. Although FIG. 3A shows a generally cylindrical polishing element 4 having a generally circular cross section as illustrated by FIG. 3B (which shows the polishing surface 14 of a polishing element 4), other cross-sectional shapes are possible and may be desirable in certain embodiments. For example, circular, elliptical, triangular, square, rectangular, and trapezoidal cross-sectional shapes may be useful.

For cylindrical polishing elements 4 having a circular cross section as shown in FIGS. 3A and 3B, the cross-sectional diameter of the polishing element 4 in a direction generally parallel to the polishing surface 14 may be from about 50 μm to about 20 mm, in certain embodiments the cross-sectional diameter is from about 1 mm to about 15 mm, and in other embodiments the cross-sectional diameter is from about 5 mm to about 15 mm (or even about 5 mm to about 10 mm). For non-cylindrical polishing elements having a non-circular cross section, a characteristic dimension may be used to characterize the polishing element size in terms of a specified height, width, and length. In certain exemplary embodiments, the characteristic dimension may be selected to be from about 0.1 mm to about 30 mm.

In other exemplary embodiments, the cross-sectional area of each polishing element 4 in a direction generally parallel to the polishing surface 14, may be from about 1 $mm^2$ to about 1,000 $mm^2$, in other embodiments from about 10 $mm^2$ to about 500 $mm^2$, and in yet other embodiments, from about 20 $mm^2$ to about 250 $mm^2$.

The polishing elements (4 in FIG. 1, 24 in FIG. 2) may be distributed on a major side of the support layer (10 in FIG. 1, 30 in FIG. 2) in a wide variety of patterns, depending on the intended application, and the patterns may be regular or irregular. The polishing elements may reside on substantially the entire surface of the support layer, or there may be regions of the support layer that include no polishing elements. In some embodiments, the polishing elements have an average surface coverage of the support layer from about 30 to about 80 percent of the total area of the major surface of the support layer, as determined by the number of polishing elements, the cross-sectional area of each polishing element, and the cross-sectional area of the polishing pad.

The cross-sectional area of the polishing pad in a direction generally parallel to a major surface of the polishing pad may, in some exemplary embodiments, range from about 100 $cm^2$ to about 300,000 $cm^2$, in other embodiments from about 1,000 $cm^2$ to about 100,000 $cm^2$, and in yet other embodiments, from about 2,000 $cm^2$ to about 50,000 $cm^2$.

Prior to the first use of the polishing pad (2 in FIG. 1, 2' in FIG. 2) in a polishing operation, in some exemplary embodiments, each polishing element (4 in FIG. 1, 24 in FIG. 2) extends along the first direction substantially normal to the first major side of the support layer (10 in FIG. 1, 30 in FIG. 2). In other exemplary embodiments, each polishing element extends along the first direction at least about 0.25 mm above a plane including the guide plate (31 in FIG. 2). In further exemplary embodiments, each polishing element extends along the first direction at least about 0.25 mm above a plane including the support layer (10 in FIG. 1, 30 in FIG. 2). In additional exemplary embodiments, the height of the polishing surface (14 in FIG. 1, 23 in FIG. 2) above the base or bottom of the polishing element (2 in FIG. 1, 2' in FIG. 2) may be 0.25 mm, 0.5 mm, 1.5 mm, 2.0 mm, 2.5 mm, 3.0 mm, 5.0 mm, 10 mm or more, depending on the polishing composition used and the material selected for the polishing elements.

Referring again to FIGS. 1-2, the depth and spacing of the apertures (6 in FIG. 1, 26 in FIG. 2) throughout the polishing composition distribution layer (8 in FIG. 1, 28 in FIG. 2) and guide plate 31 may be varied as necessary for a specific CMP process. The polishing elements (4 in FIG. 1, 24 in FIG. 2) are each maintained in planar orientation with respect to one other and the polishing composition distribution layer (8 in FIG. 1, 28 in FIG. 2) and guide plate 31, and project above the surface of the polishing composition distribution layer (8 in FIG. 1, 28 in FIG. 2) and guide plate 31.

In some exemplary embodiments, the volume created by the extension of the polishing elements (4 in FIG. 1, 24 in FIG. 2) above the guide plate 31 and any polishing composition distribution layer (8 in FIG. 1, 28 in FIG. 2) may provide room for distribution of a polishing composition on the surface of the polishing composition distribution layer (8 in FIG. 1, 28 in FIG. 2). The polishing elements (4 in FIG. 1, 24 in FIG. 2) protrude above the polishing composition distribution layer (8 in FIG. 1, 28 in FIG. 2) by an amount that depends at least in part on the material characteristics of the polishing elements and the desired flow of polishing composition (working liquid and or abrasive slurry) over the surface of the polishing composition distribution layer (8 in FIG. 1, 28 in FIG. 2).

As illustrated by FIGS. 1-2, at least a portion of the polishing elements 4 (or flanged polishing elements 24) are porous polishing elements, which in certain embodiments at least have a porous polishing surface (14 in FIG. 1, 23 in FIG. 2), which may make sliding or rotational contact with a substrate (not shown in FIG. 1) to be polished. In other embodiments, the porous polishing elements may not have a porous polishing surface, but may have pores distributed throughout substantially the entire porous polishing element. Such porous polishing elements may be useful as compliant polishing elements exhibiting some of the advantageous characteristics of a compliant polishing pad.

In some particular exemplary embodiments, one or more of the polishing elements 4 may comprise a plurality of pores 15 distributed throughout substantially the entire polishing element 4 in the form of a porous foam. The foam may be a closed cell foam, or an open cell foam. Closed cell foams may be preferred in some embodiments. Preferably, the plurality of pores 15 in the foam exhibits a unimodal distribution of pore size, for example, pore diameter. In some exemplary embodiments, the plurality of pores exhibits a mean pore size from about 1 nanometer to about 100 μm. In other exemplary embodiments, the plurality of pores exhibits a mean pore size from about 1 μm to about 50 μm.

Referring now to FIGS. 3A-3C and 4A-4C, the polishing surface 14 (FIGS. 3A-3B) or 23 (FIGS. 4A-4C) of polishing element 4 (FIGS. 3A-3B) or flanged polishing element 24 (FIGS. 4A-4C) may be a substantially flat surface, or may be textured. In certain presently preferred embodiments, at least the polishing surface of each porous polishing element is made porous, for example with microscopic surface openings or pores 15, which may take the form of orifices, passageways, grooves, channels, and the like. Such pores 15 at the polishing surface may act to facilitate distributing and maintaining a polishing composition (e.g., a working liquid and/or abrasive polishing slurry not shown in the figures) at the interface between a substrate (not shown) and the corresponding porous polishing elements.

Figure 3C:
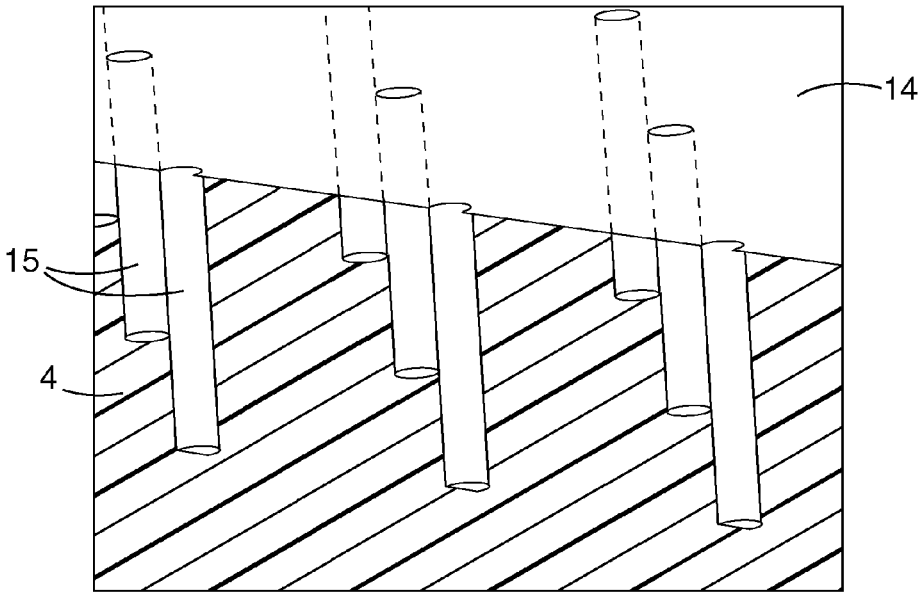
FIG. 3C is a magnified perspective view of the exemplary porous polishing element of FIG. 3A after cross-sectioning the element in a direction substantially normal to the polishing surface.

In certain exemplary embodiments illustrated by FIGS. 3A-3C, the polishing surface 14 comprises pores 15 that are generally cylindrical capillaries. The pores 15 may extend from the polishing surface 14 into the polishing element 4, as shown in FIG. 3C. In a related embodiment, the polishing surface comprises pores 15 that are generally cylindrical capillaries extending from the polishing surface 23 into the flanged polishing element 24. The pores need not be cylindrical, and other pore geometries are possible, for example, conical, rectangular, pyramidal, and the like. The characteristic dimensions of the pores can, in general, be specified as a depth, along with a width, length, or diameter. The characteristic pore dimensions may range from about 25 micrometers (μm) to about 6,500 μm in depth, about 5 μm to about 500 μm in width, about 10 μm to about 1,000 μm in length, and about 5 μm to about 1,000 μm in diameter.

Figure 4B:
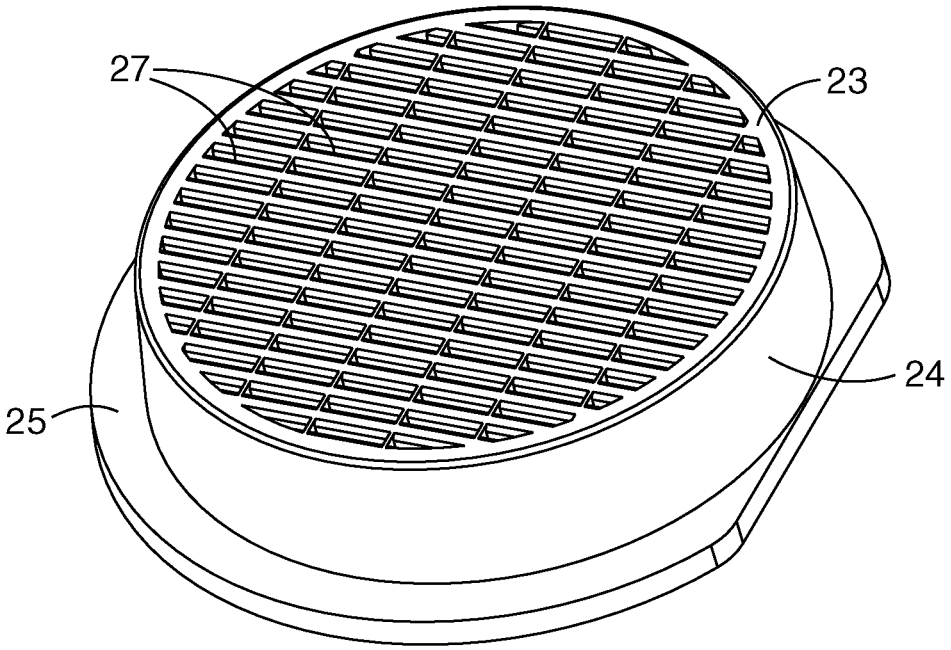
FIG. 4B is a perspective view of a porous polishing element according to another exemplary embodiment of the disclosure.
Figure 4C:
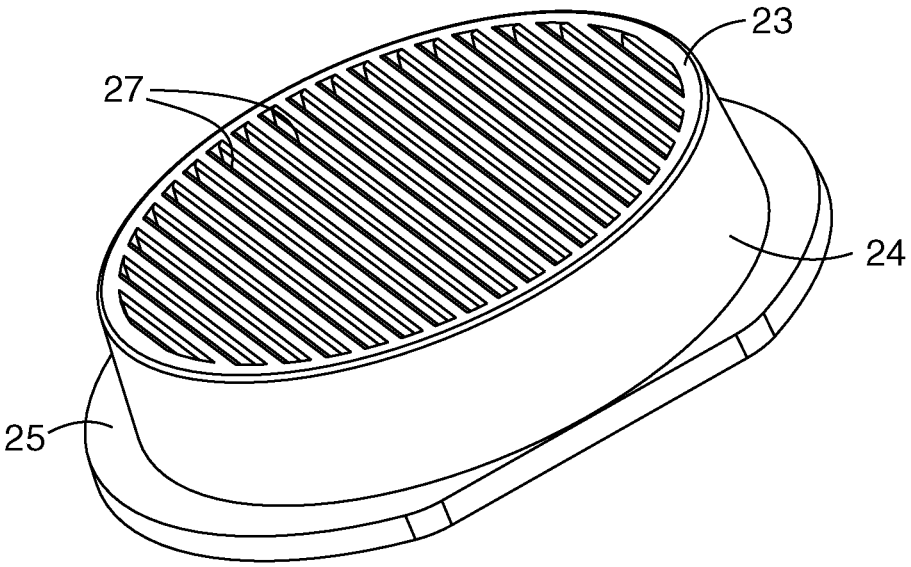
FIG. 4C is a perspective view of a porous polishing element according to a further exemplary embodiment of the disclosure.

In other exemplary embodiments illustrated by FIG. 4B, the polishing surface 23 comprises pores in the form of a plurality of channels 27, wherein each channel 27 extends across at least a portion of the polishing surface 23 of a corresponding polishing element 24, preferably in a direction generally parallel to the polishing surface 23. Preferably, each channel 27 extends across the entire polishing surface 23 of a corresponding polishing element 24 in a direction generally parallel to the polishing surface 23. In other exemplary embodiments illustrated by FIG. 4C, the pores may take the form of a two-dimensional array of channels 27 in which each channel 27 extends across only a portion of the polishing surface 23.

In further exemplary embodiments, the channels 27 may have virtually any shape, for example, cylindrical, triangular, rectangular, trapezoidal, hemispherical, and combinations thereof. In some exemplary embodiments, the depth of each channel 27 in the direction substantially normal to the polishing surface 23 of the polishing elements 24 is selected to be from about 100 μm to about 7500 μm. In other exemplary embodiments, the cross-sectional area of each channel 27 in the direction substantially parallel to the polishing surface 23 of the polishing elements 24 is selected to be from about 75 square micrometers ($\mu m^2$) to about $3\times10^6$ $\mu m^2$.

In further exemplary embodiments, the support layer comprises a flexible and compliant material, such as a compliant rubber or polymer. The support layer can be incompressible, such as a rigid frame or a housing, but is preferably compressible to provide a positive pressure directed toward the polishing surface. In some exemplary embodiments, the support layer is preferably made of a compressible polymeric material, foamed polymers being preferred, and foamed polymeric materials. Closed cells may be preferred. In some exemplary embodiments, the polishing elements, at least a portion of which comprise porous polishing elements, may be formed with the support layer as a unitary sheet of polishing elements affixed to the support layer, which may be a porous support layer.

In some exemplary embodiments, the support layer comprises a polymeric material selected from silicone, natural rubber, styrene-butadiene rubber, neoprene, polyurethane, and combinations thereof. The support layer may further comprise a wide variety of additional materials, such as fillers, particulates, fibers, reinforcing agents, and the like. The support layer is preferably fluid impermeable (although permeable materials may be used in combination with an optional barrier to prevent or inhibit fluid penetration into the support layer.

Polyurethanes have been found to be particularly useful support layer materials. Suitable polyurethanes include, for example, those available under the trade designation PORON from Rogers Corp., Rogers, Conn., as well as those available under the trade designation PELLETHANE from Dow Chemical, Midland, Mich., particularly PELLETHANE 2102-65D. Other suitable materials include polyethylene terepthalates (PET), such as, for example biaxially oriented PET widely available under the trade designation MYLAR, as well as bonded rubber sheets available from Rubberite Cypress Sponge Rubber Products, Inc., Santa Ana, Calif., under the trade designation BONDTEX.

The polishing elements may comprise a wide variety of materials, with polymeric materials being preferred. Suitable polymeric materials include, for example, polyurethanes, polyacrylates, polyvinyl alcohol polyesters, polycarbonates, and acetals available under the trade designation DELRIN (available from E.I. DuPont de Nemours, Inc., Wilmington, Del.). In some exemplary embodiments, at least some of the polishing elements comprise a thermoplastic polyurethane, a polyacrylate, polyvinyl alcohol, or combinations thereof.

The polishing elements may also comprise a reinforced polymer or other composite material, including, for example, metal particulates, ceramic particulates, polymeric particulates, fibers, combinations thereof, and the like. In certain embodiments, polishing elements may be made electrically and/or thermally conductive by including therein fillers such as, carbon, graphite, metals or combinations thereof. In other embodiments, electrically conductive polymers such as, for example, polyanilines (PANI) sold under the trade designation ORMECOM (available from Ormecon Chemie, Ammersbek, Germany) may be used, with or without the electrically or thermally conductive fillers referenced above.

The guide plate can be made of a wide variety of materials, such as polymers, copolymers, polymer blends, polymer composites, or combinations thereof. A non-conducting and liquid impermeable polymeric material is generally preferred, and polycarbonates have been found to be particularly useful.

The optional polishing composition distribution layer may also be made of a wide variety of polymeric materials. The polishing composition distribution layer may, in some embodiments, comprise at least one hydrophilic polymer. Preferred hydrophilic polymers include polyurethanes, polyacrylates, polyvinyl alcohols, polyoxymethylenes, and combinations thereof. The polymeric materials are preferably porous, more preferably comprising a foam to provide a positive pressure directed toward to substrate during polishing operations when the polishing composition distribution layer is compressed.

Porous or foamed materials with open or closed cells may be preferred in certain embodiments. In some particular embodiments, the polishing composition distribution layer has between about 10 and about 90 percent porosity. In an alternative embodiment, the polishing composition layer may comprise a hydrogel material, such as, for example a hydrophilic urethane, that can absorb water, preferably in a range of about 5 to about 60 percent by weight to provide a lubricious surface during polishing operations.

In some exemplary embodiments, the polishing composition distribution layer may substantially uniformly distribute a polishing composition across the surface of the substrate undergoing polishing, which may provide more uniform polishing. The polishing composition distribution layer may optionally include flow resistant elements such as baffles, grooves (not shown in the figures), pores, and the like, to regulate the flow rate of the polishing composition during polishing. In further exemplary embodiments, the polishing composition distribution layer can include various layers of different materials to achieve desired polishing composition flow rates at varying depths from the polishing surface.

In some exemplary embodiments (see e.g. FIG. 6B), one or more of the polishing elements may include an open core region or cavity defined within the polishing element, although such an arrangement is not required. In some embodiments, as described in WO/2006/055720, the core of the polishing element can include sensors to detect pressure, conductivity, capacitance, eddy currents, and the like. In yet another embodiment, the polishing pad may include a window extending through the pad in the direction normal to the polishing surface, or may use transparent layers and/or transparent polishing elements, to allow for optical endpointing of a polishing process, as described in the copending U.S. Provisional Patent Application No. 61/053,429, filed May 15, 2008, titled "POLISHING PAD WITH ENDPOINT WINDOW AND SYSTEMS AND METHOD OF USING THE SAME."

The term "transparent layer" as used above is intended to include a layer that comprises a transparent region, which may be made of a material that is the same or different from the remainder of the layer. In some exemplary embodiments, the element, layer or region may be transparent, or may be made transparent by applying heat and/or pressure to the material, or a transparent material may be cast in place in an aperture suitably positioned in a layer to create a transparent region. In an alternative embodiment, the entire support layer may be made of a material that is or may be made transparent to energy in the range of wavelength(s) of interest utilized by an endpoint detection apparatus. Preferred transparent materials for a transparent element, layer or region include, for example, transparent polyurethanes.

Furthermore, as used above, the term "transparent" is intended to include an element, layer, and or region that is substantially transparent to energy in the range of wavelength(s) of interest utilized by an endpoint detection apparatus. In certain exemplary embodiments, the endpoint detection apparatus uses one or more source of electromagnetic energy to emit radiation in the form of ultraviolet light, visible light, infrared light, microwaves, radio waves, combinations thereof, and the like. In certain embodiments, the term "transparent" means that at least about 25% (e.g., at least about 35%, at least about 50%, at least about 60%, at least about 70%, at least about 80%, at least about 90%, at least about 95%) of energy at a wavelength of interest that impinges upon the transparent element, layer or region is transmitted therethrough.

In some exemplary embodiments, the support layer is transparent. In certain exemplary embodiments, at least one polishing element is transparent. In additional exemplary embodiments, at least one polishing element is transparent, and the adhesive layer and the support layer are also transparent. In further exemplary embodiments, the support layer, the guide plate, the polishing composition distribution layer, at least one polishing element, or a combination thereof is transparent.

The present disclosure is further directed to a method of using a polishing pad as described above in a polishing process, the method including contacting a surface of a substrate with a polishing surface of a polishing pad comprising a plurality of polishing elements, at least some of which are porous, and relatively moving the polishing pad with respect to the substrate to abrade the surface of the substrate. In certain exemplary embodiments, a working liquid may be provided to an interface between the polishing pad surface and the substrate surface. Suitable working liquids are known in the art, and may be found, for example, in U.S. Pat. Nos. 6,238,592 B1; 6,491,843 B1; and WO/200233736.

The polishing pads described herein may, in some embodiments, be relatively easy and inexpensive to manufacture. Suitable manufacturing processes are described in U.S. Provisional Patent Application No. 60/926,244. A brief discussion of some exemplary manufacturing processes is described below, which discussion is not intended to be exhaustive or otherwise limiting.

Thus, in further exemplary embodiments, a method of making a polishing pad is provided, the method comprising forming a plurality of porous polishing elements, and affixing the porous polishing elements to a support layer. In certain embodiments, the method includes forming the porous polishing elements by injection molding of a gas saturated polymer melt, injection molding of a reactive mixture that evolves a gas upon reaction to form a polymer, injection molding of a mixture comprising a polymer dissolved in a supercritical gas, injection molding of a mixture of incompatible polymers in a solvent, injection molding of porous thermoset particulates dispersed in a thermoplastic polymer, and combinations thereof.

In certain additional embodiments, the porosity imparted to the polishing surface of a polishing element may be imparted, for example, by injection molding, calendaring, mechanical drilling, laser drilling, needle punching, gas dispersion foaming, chemical processing, and combinations thereof.

Exemplary embodiments of polishing pads having porous polishing elements according to the present disclosure may have various features and characteristics that enable their use in a variety of polishing applications. In some presently preferred embodiments, polishing pads of the present disclosure may be particularly well suited for chemical mechanical planarization (CMP) of wafers used in manufacturing integrated circuits and semiconductor devices. In certain exemplary embodiments, the polishing pad described in this disclosure may provide advantages over polishing pads that are known in the art.

For example, in some exemplary embodiments, a polishing pad according to the present disclosure may act to better retain a working liquid used in the CMP process at the interface between the polishing surface of the pad and the substrate surface being polished, thereby improving the effectiveness of the working liquid in augmenting polishing. In other exemplary embodiments, a polishing pad according to the present disclosure may reduce or eliminate dishing and/or edge erosion of the wafer surface during polishing. In some exemplary embodiments, use of a polishing pad according to the present disclosure in a CMP process may result in improved within wafer polishing uniformity, a flatter polished wafer surface, an increase in edge die yield from the wafer, and improved CMP process operating latitude and consistency.

In further exemplary embodiments, use of a polishing pad with porous elements according to the present disclosure may permit processing of larger diameter wafers while maintaining the required degree of surface uniformity to obtain high chip yield, processing of more wafers before conditioning of the pad surface is required in order to maintain polishing uniformity of the wafer surface, or reducing process time and wear on the pad conditioner.

Exemplary polishing pads according to the present disclosure will now be illustrated with reference to the following non-limiting examples.

EXAMPLES

The following non-limiting examples illustrate various methods for preparing both porous and non-porous polishing elements which may be used to prepare polishing pads comprising a plurality of polishing elements affixed to a support layer, wherein at least a portion of the polishing elements are porous polishing elements, and wherein at least a portion of each porous polishing element comprises a plurality of pores.

Example 1

This example illustrates the preparation of both nonporous polishing elements (Example 1A) and porous polishing elements (Example 1B) in which pores are distributed substantially throughout the entire polishing element. The porous polishing elements were prepared by injection molding of a mixture comprising a polymer dissolved in a supercritical gas.

A thermoplastic polyurethane (Estane ETE 60DT3 NAT 022P, Lubrizol Advanced Materials, Inc., Cleveland, Ohio) having a melt index of 5 at 210° C. and 3800 g of force was selected. Pellets of the thermoplastic polyurethane were fed into an 80 ton MT Arburg injection molding press (Arburg GmbH, Lossburg, Germany) equipped with a 30 mm diameter single screw (L/D=24:1) at elevated temperature and pressure to produce a polymer melt.

In comparative Example 1A, the polymer melt was injection molded into a 32-cavity, cold runner mold (solid shot weight of 9.2 grams) to form substantially nonporous polishing elements having a hollow internal cylindrical cavity and weighing 0.15 grams/element.

In Example 1B, nitrogen gas was injected under elevated temperature and pressure into the polymer melt using a Trexel SII-TR10 outfitted with a Mass Pulse Dosing delivery system (available from Trexel, Inc., Woburn, Mass.), resulting in formation of a 0.6% w/w blend of supercritical nitrogen in the polymer melt. The supercritical nitrogen and polymer melt blend was injection molded into the 32-cavity, cold runner mold (solid shot weight of 9.2 grams) to form porous polishing elements having a hollow internal cylindrical cavity and weighing 0.135 g, and in which pores are distributed substantially throughout the entire polishing element.

The temperatures for each zone of the extruder, mold temperature, screw, injection, pack pressures, molding times and clamp tonnages are summarized in Table 1 for comparative Example 1A and 1B.

TABLE 1

| Extrusion Parameter | Example 1A (Nonporous) | Example 1B (Porous) |
|---|---|---|
| Zone 1 Temperature (Feed) (° C.) | 182.2 | 182.2 |
| Zone 2 Temperature (° C.) | 187.8 | 187.8 |
| Zone 3 Temperature (° C.) | 204.4 | 204.4 |
| Zone 4 Temperature (° C.) | 215.6 | 215.6 |
| Zone 6 Temperature (Nozzle) (° C.) | 215.6 | 215.6 |
| Zone 7 Temperature (Nozzle) (° C.) | 215.6 | 215.6 |
| Screw Speed (% of maximum) | 2 | 2.5 |
| Mold Temperature (° C.) | 32.2 | 100 |
| Screw Pressure (kg/cm2) | 105.5 | 175.8 |
| Nitrogen Concentration (%) | 0 | 0.6 |
| Nitrogen Injection Time (seconds) | 0 | 1.5 |
| Injection Time (seconds) | 0.29 | 0.2 |
| Peak Injection Pressure (kg/cm2) | 1863.1 | 1687.4 |
| Pack Time (seconds) | 2.5 | 1 |
| Pack Pressure (kg/cm2) | 703.1 | 246.1 |
| Cool Time (seconds) | 12 | 14 |
| Clamp Tonnage (kg) | 79832.3 | 36287.4 |

Figure 5A:
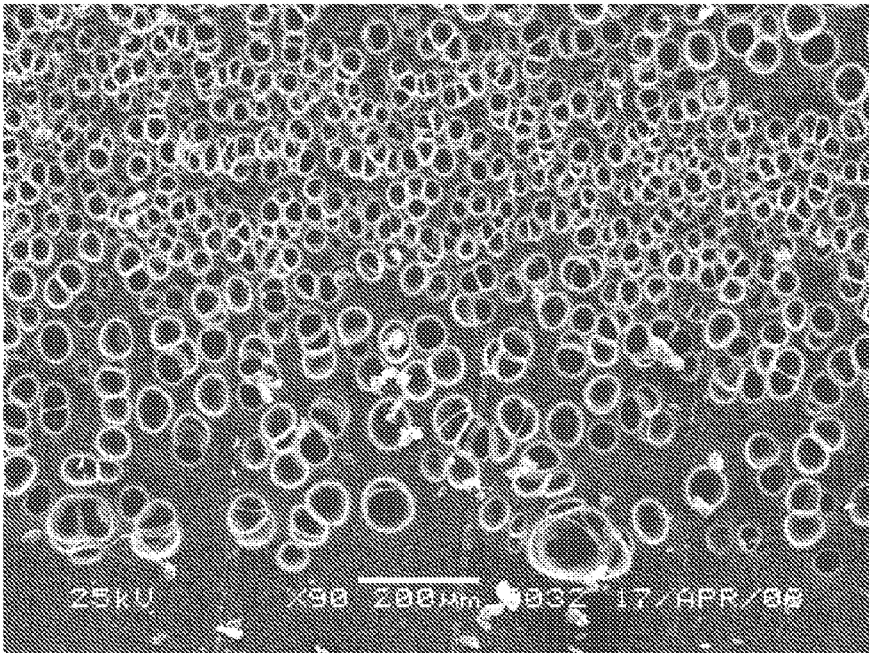
FIG. 5A is a micrograph of a porous polishing element after cross-sectioning the element in a direction substantially parallel to the polishing surface according to an exemplary embodiment of the disclosure.
Figure 5B:
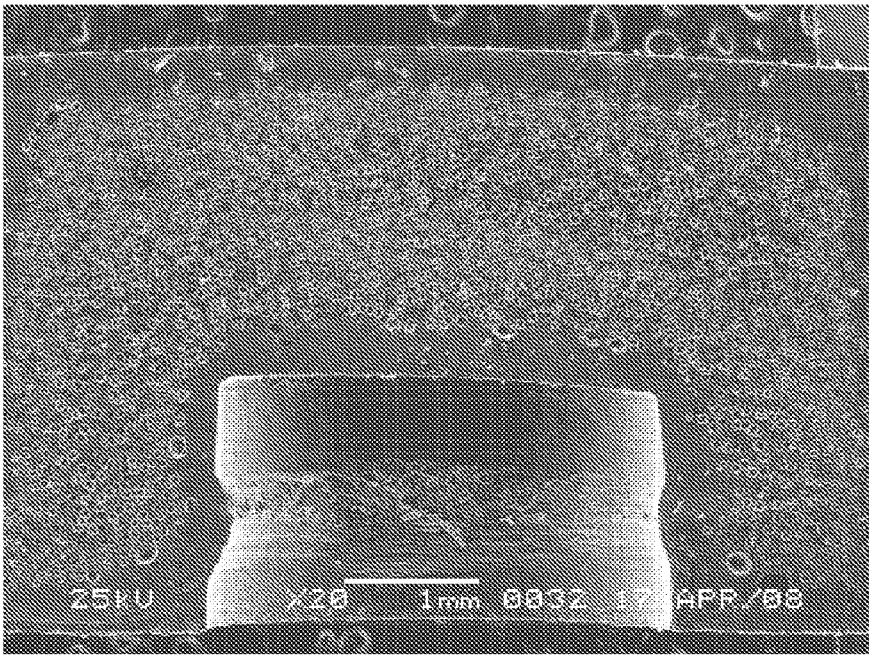
FIG. 5B is a micrograph of the porous polishing element of FIG. 5A after cross-sectioning the element in a direction substantially normal to the polishing surface.

FIG. 5A is a micrograph of a porous polishing element of Example 1B after cross-sectioning the element in a direction substantially parallel to the polishing surface according to another exemplary embodiment of the disclosure. FIG. 5B is a micrograph of the porous polishing element of FIG. 5A after cross-sectioning the element in a direction substantially normal to the polishing surface. Based on the micrograph of FIG. 5A, the mean pore size was determined as 33.208 μm; the median pore size was determined as 30.931 μm; the standard deviation of the pore size distribution was determined as 13.686 μm; the minimum pore size was determined as 3.712 μm; and the maximum pore size was determined as 150.943 μm.

Example 2

This example illustrates the preparation of a porous polishing element in which pores are distributed substantially only at the polishing surface of the element.

Nonporous polishing elements were first prepared by injection molding a thermoplastic polyurethane (Estane ETE 60DT3 NAT 022P, Lubrizol Advanced Materials, Inc., Cleveland, Ohio) having a melt index of 5 at 210° C. and 3800 g of force to form generally cylindrical polishing elements measuring about 15 mm in diameter, as described generally above in comparative Example 1A.

The polishing surface of an injection molded polishing element was then laser drilled to form a porous polishing element using an AVIA 355 nm ultraviolet laser (Coherent, Inc., Santa Clara, Calif.) operating with a nanosecond pulse rate, repetition rate of 15 kHz, power setting of 60-80% (0.8-1.1 watts) and a scan rate between 100 mm/sec to 300 mm/sec (run time total of 29.8 seconds and 13.2 seconds).

Figure 6A:
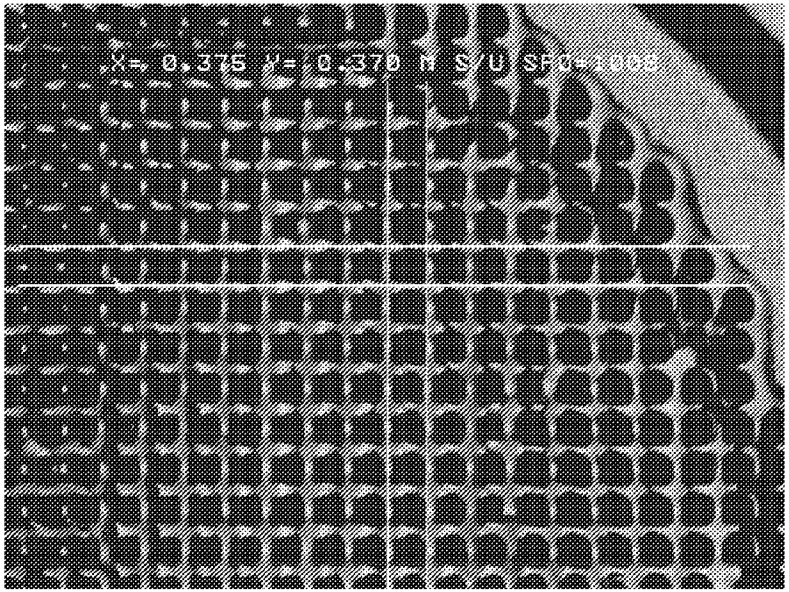
FIG. 6A is a micrograph of the porous polishing surface of a porous polishing element according to an additional exemplary embodiment of the disclosure.
Figure 6B:
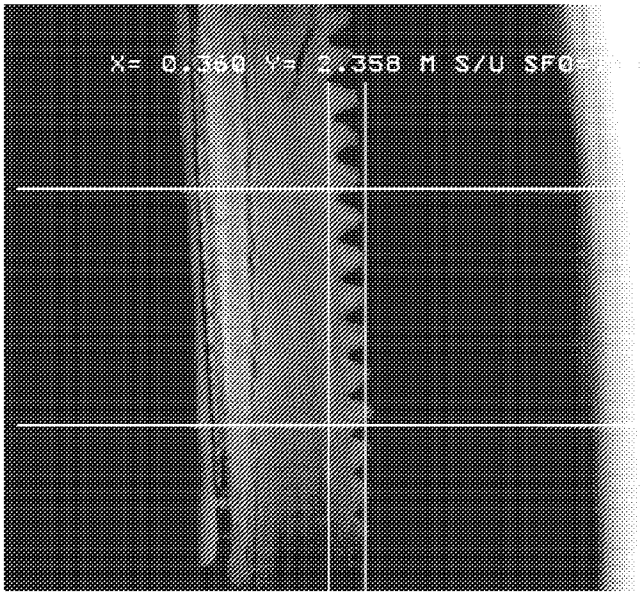
FIG. 6B is a micrograph of the porous polishing element of FIG. 6A after cross-sectioning the element in a direction substantially normal to the polishing surface.

The porous surface of a porous polishing element prepared according to this Example 2 is shown in the micrograph of FIG. 6A. FIG. 6B is a micrograph of the porous polishing element of FIG. 6A after cross-sectioning the element in a direction substantially normal to the polishing surface.

Example 3

This example illustrates the preparation of both nonporous polishing elements (Example 3A) and porous polishing elements (Example 3B) in which pores are distributed substantially only at the polishing surface of the element in the form of a plurality of channels formed on the polishing surface.

Porous polishing elements were prepared by injection molding a thermoplastic polyurethane (Estane ETE 60DT3 NAT 022P, Lubrizol Advanced Materials, Inc., Cleveland, Ohio) having a melt index of 5 at 210° C. and 3800 g of force. Pellets of the thermoplastic polyurethane were fed into an Engel 100 ton injection molding press (Engel Machinery, Inc., York, Pa.) equipped with a 25 mm diameter single screw (L/D=24.6:1) at elevated temperature and pressure to produce a polymer melt.

The thermoplastic polyurethane melt was injection molded into a 2-cavity, cold runner mold (shot weight of 34.01 grams) equipped with a ribbed mold insert in one cavity and a blank mold insert in the other cavity. The temperatures for each zone of the extruder, mold temperature, injection and pack pressures, molding times and clamp tonnages are summarized in Table 2.

TABLE 2

| Extrusion Parameter | Value |
|---|---|
| Zone 1 Temperature (Feed) (° C.) | 49 |
| Zone 2 Temperature (° C.) | 193.3 |
| Zone 3 Temperature (° C.) | 204.4 |
| Zone 4 Temperature (° C.) | 204.4 |
| Screw Speed (rpm) | 300 |
| Mold Temperature (° C.) | 12.8 |
| Injection Time (seconds) | 1.25 |
| Peak Injection Pressure (kg/cm2) | 2109.2 |
| Pack Time (seconds) | 9 |
| Pack Pressure (kg/cm2) | 421.8 |
| Cool Time (seconds) | 50 |
| Clamp Tonnage (kg) | 36287.4 |

Figure 7:
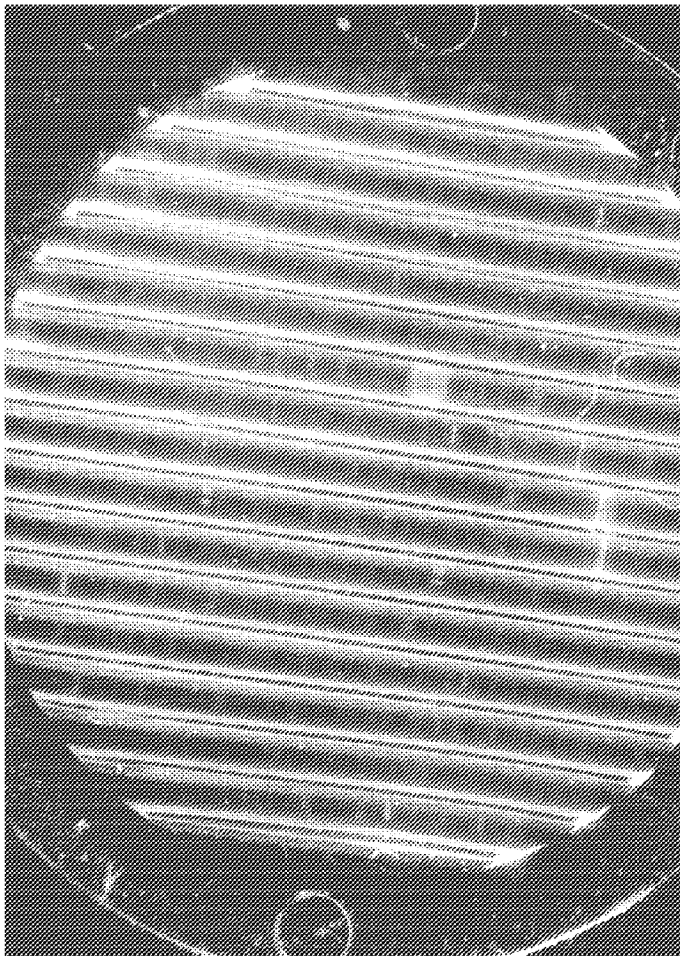
FIG. 7 is a micrograph of the porous polishing surface of a porous polishing element according to yet another exemplary embodiment of the disclosure.

FIG. 7 is a micrograph showing the plurality of channels formed by the ribbed mold insert on the polishing surface of a porous polishing element according to yet another exemplary embodiment of the disclosure.

Using the teachings provided in the Detailed Description hereinabove, individual porous and optionally, nonporous polishing elements may be affixed to a support layer to provide polishing pads according to various embodiments of the present invention. In one particularly advantageous embodiment illustrating a unitary polishing pad, a multi-cavity mold may be provided with a back-fill chamber, wherein each cavity corresponds to a polishing element. A plurality of polishing elements, which may include porous polishing elements and nonporous polishing element as described herein, may be formed by injection molding a suitable polymer melt into the multi-cavity mold, and back-filling the back-fill chamber with the same polymer melt or another polymer melt to form a support layer. The polishing elements remain affixed to the support layer upon cooling of the mold, thereby forming a plurality of polishing elements as a unitary sheet of polishing elements with the support layer.

Reference throughout this specification to "one embodiment", "certain embodiments", "one or more embodiments" or "an embodiment", whether or not including the term "exemplary" preceding the term "embodiment", means that a particular feature, structure, material, or characteristic described in connection with the embodiment is included in at least one embodiment of the certain exemplary embodiments of the present invention. Thus, the appearances of the phrases such as "in one or more embodiments", "in certain embodiments", "in one embodiment" or "in an embodiment" in various places throughout this specification are not necessarily referring to the same embodiment of the certain exemplary embodiments of the present invention. Furthermore, the particular features, structures, materials, or characteristics may be combined in any suitable manner in one or more embodiments.

While the specification has described in detail certain exemplary embodiments, it will be appreciated that those skilled in the art, upon attaining an understanding of the foregoing, may readily conceive of alterations to, variations of, and equivalents to these embodiments. Accordingly, it should be understood that this disclosure is not to be unduly limited to the illustrative embodiments set forth hereinabove. In particular, as used herein, the recitation of numerical ranges by endpoints is intended to include all numbers subsumed within that range (e.g. 1 to 5 includes 1, 1.5, 2, 2.75, 3, 3.80, 4, and 5). In addition, all numbers used herein are assumed to be modified by the term 'about'. Furthermore, all publications and patents referenced herein are incorporated by reference in their entirety to the same extent as if each individual publication or patent was specifically and individually indicated to be incorporated by reference.

Various exemplary embodiments have been described. These and other embodiments are within the scope of the following claims.

The invention claimed is:

1. A polishing pad, comprising:

a plurality of polishing elements comprising a polymeric material selected from the group consisting of a thermoplastic polyurethane, polyacrylate, polycarbonates, polyvinyl alcohol, acetals and combinations thereof, wherein at least one of the polishing elements comprises a porous polishing element, and wherein at least a surface of each porous polishing element comprises a plurality of pores, and a support layer of a polymeric material selected from the group consisting of silicone, natural rubber, styrene-butadiene rubber, neoprene, polyurethane, and combinations thereof;

each of the polishing elements affixed to a support layer so as to restrict lateral movement of the polishing elements with respect to one or more of the other polishing elements, but remaining moveable in an axis normal to a polishing surface of the polishing elements, wherein the plurality of polishing elements are bonded directly to the support layer to form a unitary sheet.

2. The polishing pad of claim 1, wherein each polishing element extends at least about 0.25 mm above a plane including the support layer.

3. The polishing pad of claim 1, wherein substantially all of the polishing elements comprise porous polishing elements.

4. The polishing pad of claim 1, wherein the plurality of pores comprising each porous polishing element are distributed throughout substantially the entire porous polishing element.

5. The polishing pad of claim 1, wherein a cavity is defined within one or more of the polishing elements.

6. The polishing pad of claim 1, wherein the plurality of pores exhibits a unimodal distribution of pore size.

7. The polishing pad of claim 1, wherein the plurality of pores exhibits a mean pore size from about 1 nanometer to about 100 micrometers.

8. The polishing pad of claim 1, wherein the polishing elements have at least one dimension from about 0.1 mm to about 30 mm.

9. The polishing pad of claim 1, further comprising an adhesive layer adjacent to the support layer opposite the plurality of polishing elements.

10. The polishing pad of claim 1, wherein at least one polishing element is transparent.

11. The polishing pad of claim 1, wherein at least a portion of the polishing elements comprise abrasive particulates.

12. A method of using a polishing pad comprising:

contacting a surface of a substrate with a polishing surface of a polishing pad according to claim 1;

relatively moving the polishing pad with respect to the substrate to abrade the surface of the substrate.

13. The method of claim 12, further comprising providing a working liquid to an interface between the polishing pad surface and the substrate surface.

14. A method of making a polishing pad comprising:

forming a plurality of porous polishing elements;

affixing the porous polishing elements to a support layer to form a polishing pad according to claim 1.

15. The method of claim 14, wherein the porous polishing elements are formed by injection molding of a gas saturated polymer melt, injection molding of a reactive mixture that evolves a gas upon reaction to form a polymer, injection molding of a mixture comprising a polymer dissolved in a supercritical gas, injection molding of a mixture of incompatible polymers in a solvent, injection molding of porous thermoset particulates dispersed in a thermoplastic polymer, and combinations thereof.

16. The method of claim 14, wherein the pores are formed by injection molding, calendaring, mechanical drilling, laser drilling, needle punching, gas dispersion foaming, chemical processing, and combinations thereof.

17. A method for making a polishing pad, comprising:

injecting a first polymeric material into a first cavity of a multi-cavity mold to form an plurality of polishing elements, wherein the first polymeric material is selected from the group consisting of thermoplastic polyurethane, polyacrylate, polycarbonates, polyvinyl alcohol, acetals and combinations thereof, wherein at least one of the polishing elements comprises a porous polishing element, and wherein at least a surface of each porous polishing element comprises a plurality of pores, and injecting a second polymeric material into a second cavity of the multi-cavity mold to form a support layer, wherein the second polymeric material is selected from the group consisting of silicone, natural rubber, styrene-butadiene rubber, neoprene, polyurethane, and combinations thereof; and cooling the multi-cavity mold such that the polishing elements are affixed to the support layer and form a unitary sheet with the support layer.

* * * * *